US006196419B1

(12) United States Patent
Haney et al.

(10) Patent No.: US 6,196,419 B1
(45) Date of Patent: Mar. 6, 2001

(54) PISTOL-SHAPED CAP FOR USE IN DISPENSING PERSONAL PROTECTION DEFENSIVE SUBSTANCES

(75) Inventors: Eric I. Haney, Atlanta, GA (US); Klaus O Pust, Gadsden; Larry C. Martin, Fultondale, both of AL (US)

(73) Assignee: Diversified Safety Products, Inc., Gadsden, AL (US)

( * ) Notice: Subject to any disclaimer, the term of this patent is extended or adjusted under 35 U.S.C. 154(b) by 0 days.

(21) Appl. No.: 09/337,773

(22) Filed: Jun. 22, 1999

Related U.S. Application Data

(60) Provisional application No. 60/090,364, filed on Jun. 23, 1998.

(51) Int. Cl.[7] ..... A63H 3/18

(52) U.S. Cl. ..... 222/79; 222/153.03; 222/182; 222/325

(58) Field of Search ..... 222/153.03, 153.04, 222/153.11, 182, 183, 153.14, 162, 325, 402.11, 79

(56) References Cited

U.S. PATENT DOCUMENTS

| | | | | |
|---|---|---|---|---|
| 1,880,354 | * | 10/1932 | Mueller | 222/79 |
| 2,109,589 | * | 3/1938 | Horwitt et al. | 222/79 |
| 4,044,922 | | 8/1977 | Bordelon | 222/183 |
| 4,223,804 | | 9/1980 | Morris et al. | 222/3 |
| 4,301,947 | | 11/1981 | Potter | 222/182 |
| 4,402,430 | | 9/1983 | Fox et al. | 222/183 |
| 4,449,474 | | 5/1984 | Mariol | 116/2 |
| 4,511,062 | | 4/1985 | Wilkerson | 222/47 |
| 5,088,624 | | 2/1992 | Hackett et al. | 222/78 |
| 5,348,193 | | 9/1994 | Bruckner et al. | 222/175 |
| 5,366,118 | | 11/1994 | Ciammitti et al. | 222/153 |
| 5,397,029 | | 3/1995 | West | 222/79 |
| 5,509,581 | | 4/1996 | Parsons | 222/153.13 |
| 5,842,602 | | 12/1998 | Pierpoint | 222/1 |
| 5,901,723 | | 5/1999 | Ames | 135/66 |

* cited by examiner

*Primary Examiner*—Philippe Derakshani
*Assistant Examiner*—Thach H Bui
(74) *Attorney, Agent, or Firm*—Garvey, Smith, Nehrbass & Doody, LLC

(57) ABSTRACT

A chemical irritant dispensing apparatus for dispensing pepper spray, mace, tear gas or the like, includes a frame having a handle with a cavity and a barrel. The barrel has a bore that is preferably cylindrically shaped, having a central longitudinal axis that defines a line of fire. A chemical irritant fluid containing canister occupies the cavity during use, the canister having an upper end portion with a trigger receptive recess. A trigger pivots upon the frame, the trigger being positioned to dispense the contents of the canister when depressed by a user. The trigger has a stop portion that prevents rotation in a direction that would enable the canister to be removed from the frame. A safety prevents any movement of the canister relative to the frame when in a safety, non-firing position. The safety can be moved to a non-firing position by a user.

22 Claims, 3 Drawing Sheets

PISTOL-SHAPED CAP FOR USE IN DISPENSING PERSONAL PROTECTION DEFENSIVE SUBSTANCES

TITLE OF THE INVENTION

"Pistol-shaped Cap for Use in Dispensing Personal Protection, Defensive Substances" INVENTOR(S): Eric L. Haney, a U.S. citizen, of 101 Roanoke Avenue N.E., Atlanta, Ga. 30305; Klaus O. Pust, a U.S. Citizen, of 2446 Hwy 278 East, Gadsden, Ala. 35903; and Larry C. Martin, a U.S. citizen, of 1704 Elkwood Dr., Fultondale, Ala. 35068

CROSS-REFERENCE TO RELATED APPLICATIONS

Priority of U.S. Provisional patent application Ser. No. 60/090,364, filed Jun. 23, 1998, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to dispensing of non-lethal gas, fluid chemical irritants, and like liquid material such as pepper spray, tear gas and the like. More particularly, the present invention relates to an improved cap arrangement that fits the top of a canister containing a chemical irritant liquid, wherein a frame attached to the top of the dispensing canister has a trigger that prevents removal of the canister from the frame. The trigger fires the canister to dispense its liquid contents when the trigger is pulled, urging the canister upwardly into engagement with the frame to activate the canister's valve and dispense its contents.

2. General Background of the Invention

There are a number of non-lethal liquids and gases that have been manufactured for self-defense purposes. Many of these non-lethal fluids are available in canister form. An example of such a non-lethal fluid is pepper spray which represents an excellent, non-lethal means of self defense.

One major drawback to the use of non-lethal fluids is that under duress, cylindrically shaped cans can be inadvertently discharged in the wrong direction. These cans do not provide any usable type of proper aiming device.

Some prior art designs have provided an aiming device in the shape of a pistol shaped frame. However, such devices can be complicated, having too many moving parts rendering them unacceptable.

Another problem that has plagued holders that receive a canister of non-lethal fluid is the orientation of the canister relative to the user's hand. Most devices are held in the user's hand in a generally vertical position which suffers from the problem of improper aim. Pistol shaped devices, flashlight shaped devices and night stick shaped devices have been proposed. However, these designs typically align the central longitudinal axis of the canister with the line of fire. In such a situation, the canister is improperly oriented for a full dispensing of its contents rendering use of the device ineffective in some situations.

Examples of aerosol can-type spray devices for discharging a chemical or fluid, non-lethal gas are shown in various patents. For example, the Bruckner Pat. No. 5,348,193 discloses an aerosol dispenser that comprises a body having an interior for holding an aerosol can. The body has a bottom portion with an opening therein that permits the insertion of the can into the interior in a first direction. A fastening end piece located on the bottom portion of the body holds the aerosol can within the interior and engages the body in a direction substantially orthogonal to the first direction of can insertion. In addition, the aerosol can may be inserted in a direction substantially parallel with the major axis of the body. The fastening end piece may have a lug which protrudes into the interior of the body when the fastening end piece has engaged the body, and the fastening end piece may engage the body by sliding into place. In one particular aspect, the aerosol dispenser is used for discharging a chemical repellant, such as tear gas.

Other patents that show generally the concept of an anti-personnel device using non-lethal gas or fluid include the Bordelon Pat. No. 4,044,922; the Morris Pat. No. 4,223,804; the Fox Pat. No. 4,402,430; the Potter Pat. No. 4,301,947; the Mariol Pat. No. 4,449,474; the Wilkerson Pat. No. 4,511,062; and the Hackett Pat. No. 5,088,624.

The Ciammitti et al. Pat. No. 5,366,118 discloses a holder for an aerosol canister. The holder has a housing and a cap. The cap receives the valve stem of the canister, and when depressed will discharge the contents of the canister at a discharge nozzle in the cap. An annular locking ring has a projection in which one position prevents the cup from being pressed downwardly relative to the housing. The '118 patent discloses (FIG. 3) a canister that is generally cylindrically shaped having an upper valve 18 with a valve stem 16 that communicates with a nozzle 15. Pressurized fluid contained within the canister is released at the nozzle when the stem or plunger is depressed causing the valve to open.

The Parsons Pat. No. 5,509,581 discloses a chemical irritant dispenser that includes an in line nozzle, chemical canister and actuator, whereby the dispenser may be held in the palm of the hand with the actuator between the thumb and forefinger and the nozzle at the heel of the hand, the dispenser further including a safety lock at the actuator end, the safety lock configured to be moved between the latched and unlatched positions by an upward movement of the thumb and the actuator configured to be operated by a forward movement of the thumb, without repositioning the dispenser in the hand.

The Ames Pat. No. 5,901,723 discloses a security cane with pepper spray dispenser. In the '723 patent, a pepper spray canister is mounted in the tubular bore of a cane or walker leg or handle, which is actuated by a trigger mounted adjacent, or in, the handle after release of a safety interlock. Several embodiments are shown, both with the canister in the handle or remote therefrom, and wherein the spray can exit the base (tip) of the cane leg or adjacent the handle. One embodiment comprises a trigger interlock button sleeve mountable at the top of the leg with the canister, actuable by a rod passing down the leg, located adjacent the lower end of the leg. Other embodiments include a straight, T-shaped or L-shaped handle which houses the canister. Several trigger mechanisms are shown: first at the rear juncture of the handle and leg; at the forward juncture thereof; or on the forward top surface of the handle.

U.S. Pat. No. 5,397,029 discloses a personal protection device which utilizes a pressurized canister of non-lethal gas. The device comprises a barrel for holding the canister, a trigger, and a handle for holding and aiming the device. The device has a handgun shape. In the preferred embodiment, the barrel pivots for quickly loading and unloading. A compartment is provided in the handle for storing a spare cartridge. A safety is disclosed to prevent inadvertent discharge of the device.

BRIEF SUMMARY OF THE INVENTION

Prior art devices for spraying chemical irritants such as pepper spray are typically either too complicated, too costly or ineffective. Some devices have canisters that are horizontally aligned with the barrel, thus only utilizing about half of the contents of necessarily small canisters.

In some devices, spraying downwards (for example, if an intruder is coming upstairs) is impossible. Many devices are so configured that only small, one ounce cans are practicable, prohibiting use by major law enforcement and government agencies. Other problems that have plagued such apparatus include dripping and fogging.

The present invention provides an improved pistol shaped cap arrangement for use on chemical irritant spray canisters such as pepper spray cans. The apparatus includes a cap, trigger and safety that can all be produced in the same injection mold. Assembly is completed using only a pin for assembling the trigger to the cap or body and a screw for attaching the safety to the cap or body. The apparatus includes a standard, cylindrically shaped can or canister that fits into a cavity of the cap or body in a near to vertical position that allows utilization of substantially all of the contents of the canister.

Opening and closing of a valve on the canister facilitates acceleration from and deceleration to zero liquid speed.

Depending upon the quickness of the valve operation, more or less liquid residue is deposited at the nozzle around zero speed. This deposit of liquid residue occurs because of capillary force at the nozzle, depending upon change of temperatures and barometric pressures.

When liquid is expelled through a nozzle of the canister, turbulence is in the wall area of the cap or body lead to mist surrounding the liquid stream which can easily effect the user, especially in wind conditions. These above problems are eliminated by the insertion of a foam sleeve into the barrel. This sleeve is preferable of a non-oil degradable absorbent material which catches droplets and mist. Over time, the oil evaporates, but the pepper is retained.

A lanyard cavity is generally cylindrically shaped so that it can be used to accept a small tube of decontamination lotion.

The canisters are inserted while the safety is engaged. The trigger is mounted to the cap or body, with a rearwardly extending portion that dips under the crimp of the can. Discharge occurs when the safety is disengaged and the trigger is pulled. The can or canister then rebounds under internal valve spring force. The canister or can cannot slip out of its cavity in the cap or body, as the trigger rebound stop touches the frame when the a canister is attempted to be separated.

Smoothness of action is facilitated by friction reduction rails. The cap or body is preferably molded from an orange plastic material to signal the presence of a non-lethal device.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 3–3A are sectional views taken along lines 3—3 of FIG. 2 wherein FIG. 3 is in the safety position and FIG. 3A is in the firing position;

DETAILED DESCRIPTION OF THE INVENTION

Figure 1:
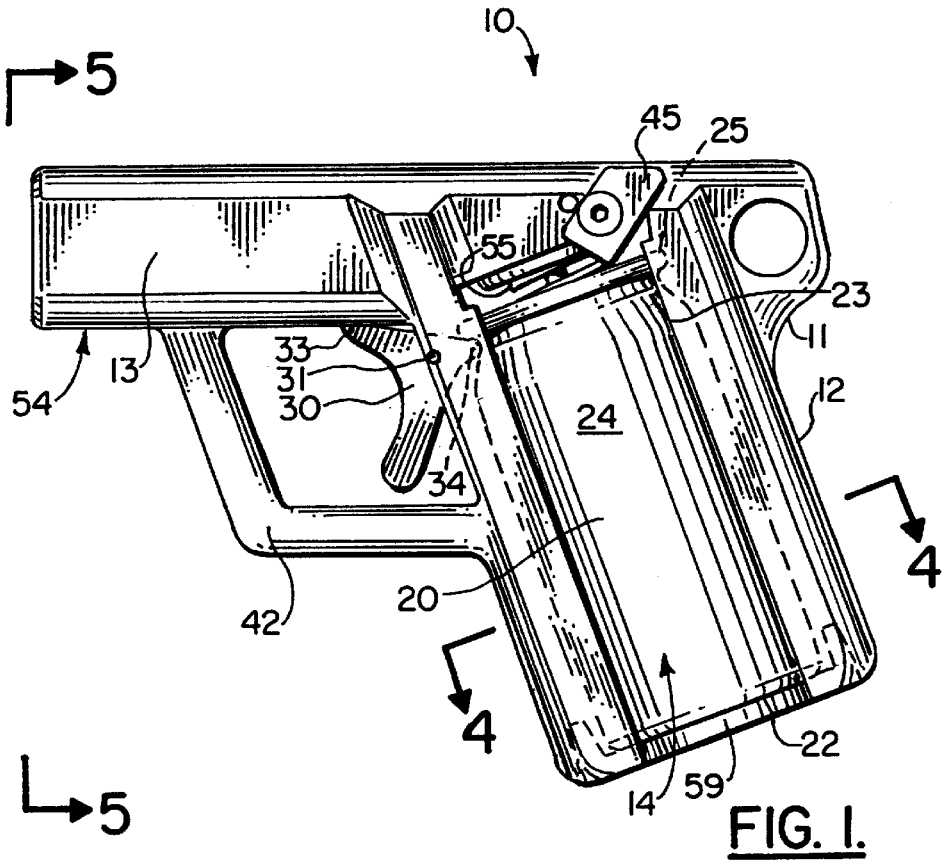
FIG. 1 is a side elevational view of the preferred embodiment of the apparatus of the present invention.

FIGS. 1–5 show the preferred embodiment of the apparatus of the present invention, designated generally by the numeral 10 in FIGS. 1–4. Irritant dispensing apparatus 10 can be used to dispense non-lethal fluid chemical irritants such as pepper spray, tear gas, etc. The apparatus 10 includes a frame 11 having a handle 12 to be gripped by a user, and a barrel 13 to be pointed in the direction of an assailant. Handle 12 has a socket 14 that is receptive of canister 20. Canister 20 is a commercially available fluid containing canister that carries a non-lethal chemical irritant such as pepper spray, tear gas, mace, or the like.

Handle 12 includes a front handle section 15 (FIG. 4) and a rear handle section 16. Each handle section 15, 16 carries a pair of spaced apart rails 17. The rails 17 are positioned at concave surface 18 of front handle section 15 and at concave surface 19 of rear handle section 16.

Figure 2:
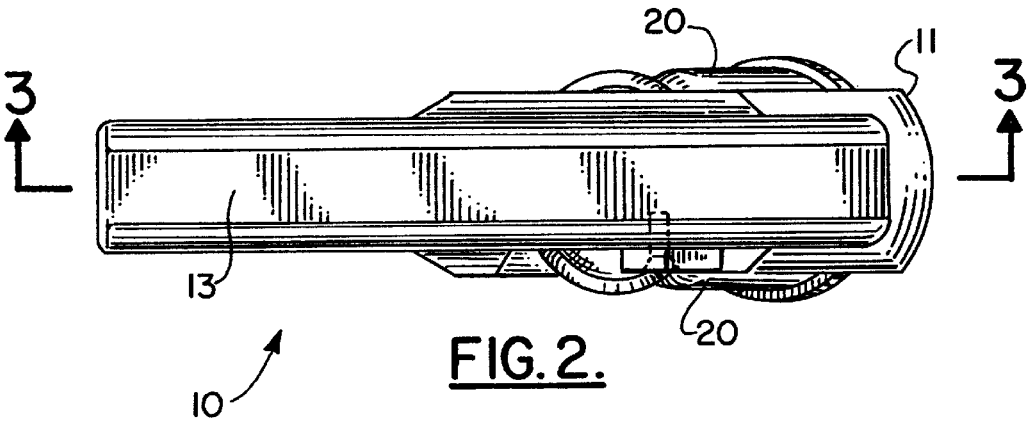
FIG. 2 is a top view of the preferred embodiment of the apparatus of the present invention.

Canister 20 is preferably cylindrically shaped having a cylindrical side wall 21, a generally flat circular bottom surface 22, and an upper end portion 23. The upper end portion 23 includes a frustoconical section 24 and an annular rib 25 that can be a crimped portion for connecting a valving member 27 to the frustoconical section 24. An annular recess 26 is provided in between frustoconical section 24 and annular rib 25. Upon assembly of the trigger 30 to frame 11, rear projecting portion 34 of trigger 30 engages annular recess 26 to secure canister 20 to frame 11. Valve 27 is a part of canister 20, providing a stem 28 and dispensing outlet 29. In FIGS. 1 and 2, trigger 30 is pivotally attached to frame 12 at pivot pin 31 in order to secure canister 20 to frame 12. Once trigger 30 and pivot pin 31 are assembled to frame 12, canister 20 cannot be removed.

Pivot pin 31 is so positioned on frame 12 and trigger 30 is so configured that the rear projecting portion 34 of trigger 30 engages recess 26 of canister 20 to prevent removal of canister 20 from frame 11. In the assembled position, downward movement of canister 20 results in annular rib 25 engaging rear projecting portion 34 of trigger 30, attempting to rotate trigger 30 about pivot pin 31. However, stop 33 prevents such rotation as the stop 33 engages bottom surface 54 of barrel 13.

Upon assembly of the apparatus 10, only upward movement of canister 20 is permitted. Upward movement is permitted when trigger 30 is pulled rearwardly by a user. To fire the apparatus 10, a user grips the handle 20, using the index or trigger finger of the user's hand to pull trigger 30 at gripping surface 32 (see FIG. 3A).

Figure 3:
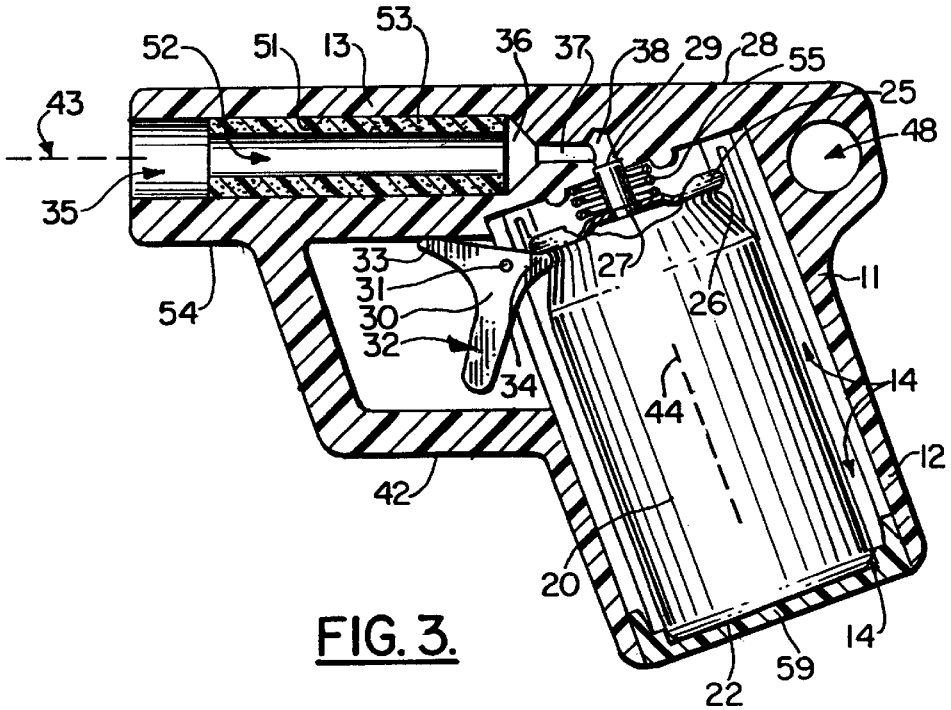
Figure 3A:
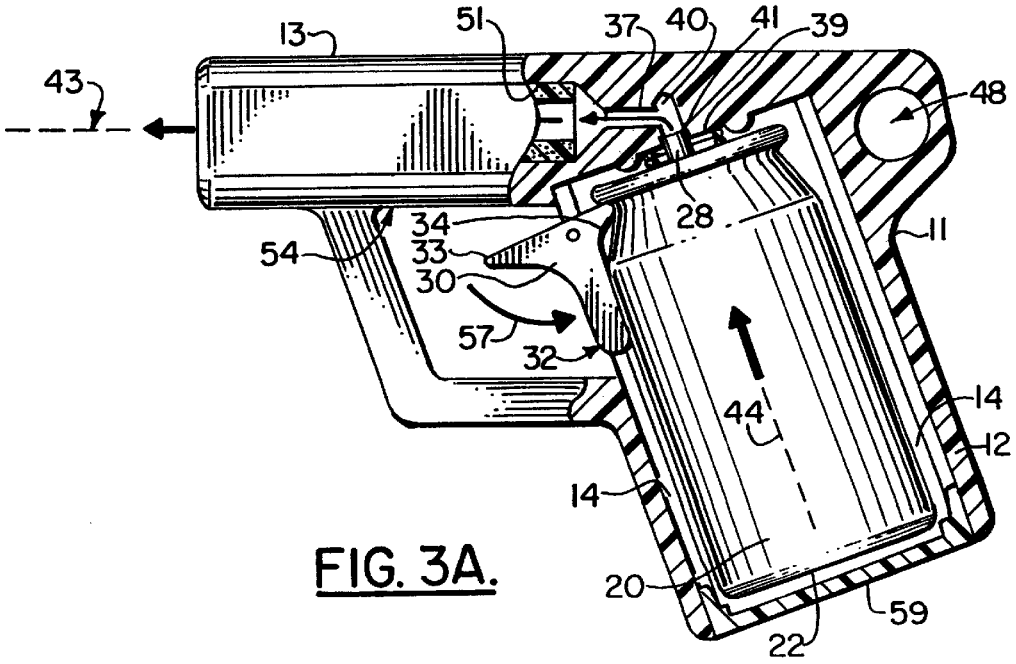

A coil spring 55 is positioned in between canister 20 and annular surface 56. The annular surface 56 surrounds transverse dispensing channel 38 as shown in FIG. 3A. Spring 55 normally pushes canister 20 downwardly relative to frame 11 and into a non-firing position. The user applies pressure to gripping surface 32 of trigger 30 in order to overcome the spring 55 and move canister 20 upwardly to a firing position. When the user depresses the trigger 30 and rotates trigger 30 in the direction of arrow 57, the canister 20 moves upwardly so that valve stem 28 of canister 20 engages annular shoulder 41.

Annular shoulder 41 is defined by the change in diameters between smaller diameter section 40 and larger diameter section 39 of transverse dispensing channel 38. When the canister 20 is moved upwardly, valve stem 28 engages annular shoulder 41. Continued upward movement of canister 20 causes the valve stem 28 to move downwardly with respect to canister 20 opening the valve 27. When valve 27 is opened, the contents of canister 20 are dispensed through dispensing outlet 29 and into transverse dispensing channel 38.

The dispensing channel 38 forms an angle of about 120 degrees with the central longitudinal axis 43 of bore 35 of barrel 13. The bore 35 communicates with conical section 36 and smaller diameter section 37 as shown in FIG. 2. When the contents of canister 20 are dispensed from valve 27 into channels 38 and 37, the contents are directed into the larger diameter section 35 of barrel 13 and travel a distance in front of barrel 13. The contents are dispensed typically a distance of about 10–26 feet.

Trigger guard 42 is provided for preventing inadvertent operation of trigger 30. In the preferred embodiment, canister 20 has a central longitudinal axis 44 that forms an angle of about 120 degrees with the central longitudinal axis 43 of bore section 35.

Figure 7:
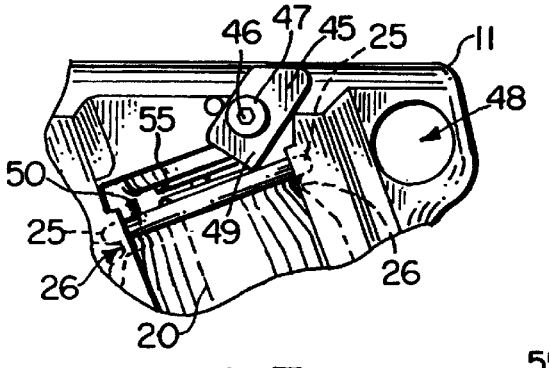
FIG. 7 is a fragmentary, side view of the preferred embodiment of the apparatus of the present invention showing the safety in a safety position.
Figure 7A:
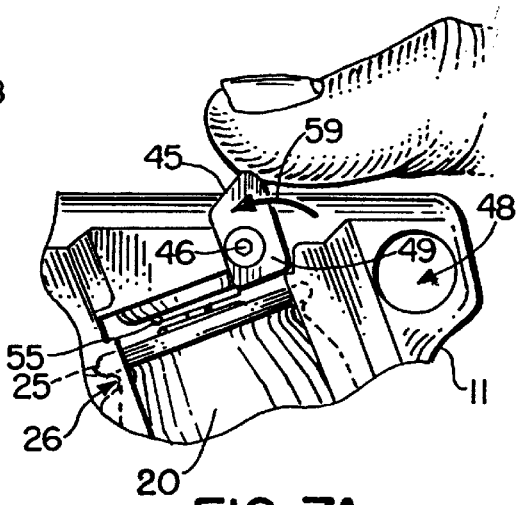
FIG. 7A is a fragmentary, side elevational view of the preferred embodiment of the apparatus of the present invention illustrating movement of the safety into the firing position.
Figure 4:
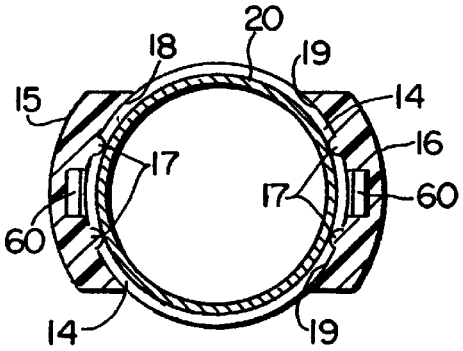
FIG. 4 is a sectional view taken along lines 4—4 of FIG. 1.
Figure 6:
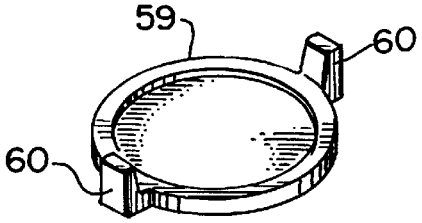
FIG. 6 is a fragmentary perspective view of the preferred embodiment of the apparatus of the present invention illustrating the handle butt plate.
Figure 5:
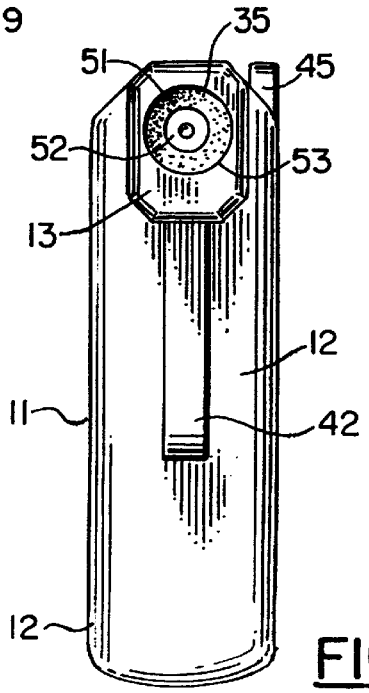
FIG. 5 is a front view of the preferred embodiment of the apparatus of the present invention taken along lines 5—5 of FIG. 1.

Safety 45 prevents inadvertent firing of the apparatus 10. In the safety position of FIGS. 1 and 7, the safety 45 is rotated so that corner 49 engages the upper surface 50 of annular rib 25. Safety 45 is pivotally attached to frame 11 at pivot opening 46, using assembly screw 47. In FIG. 7A, the safety 49 is rotated forward (see arrow 58) to the firing position.

A lanyard opening 48 can be provided at the rear of frame 11 generally opposite barrel 13. Opening 48 can be used to store a decontamination canister containing a decontamination liquid.

Larger diameter section 35 of the bore of barrel 13 is provided with a cylindrically shaped hollow open ended foam sleeve 51 having bore 52 and outer surface 53. The sleeve 51 absorbs any residual chemical irritant that remains in channels 38 or 37 after the apparatus 10 is fired. A butt plate 59 can be used to cover the bottom 22 of canister 20. Butt plate 59 attaches to handle 12 with locking tabs 60.

PARTS LIST

| | |
|---|---|
| 10 | irritant dispensing apparatus |
| 11 | frame |
| 12 | handle |
| 13 | barrel |
| 14 | socket |
| 15 | front handle section |
| 16 | rear handle section |
| 17 | rail |
| 18 | concave surface |
| 19 | concave surface |
| 20 | canister |
| 21 | cylindrical side wall |
| 22 | bottom surface |
| 23 | upper end portion |
| 24 | frustoconical section |
| 25 | annular rib |
| 26 | annular recess |
| 27 | valve |
| 28 | valve stem |
| 29 | dispensing outlet |
| 30 | trigger |
| 31 | pivot pin |
| 32 | gripping surface |
| 33 | stop |
| 34 | rear projection |
| 35 | larger diameter cylindrical section |
| 36 | conical section |
| 37 | smaller diameter section |
| 38 | transverse channel |
| 39 | larger diameter section |
| 40 | smaller diameter section |
| 41 | annular shoulder |
| 42 | trigger guard |
| 43 | bore axis |
| 44 | canister axis |
| 45 | safety |
| 46 | pivot |
| 47 | screw |
| 48 | lanyard opening |
| 49 | corner |
| 50 | upper surface of rib |
| 51 | foam sleeve |
| 52 | bore |
| 53 | outer surface |
| 54 | bottom surface |
| 55 | spring |
| 56 | annular surface |
| 57 | arrow |
| 58 | arrow |
| 59 | butt plate |
| 60 | tabs |

The foregoing embodiments are presented by way of example only; the scope of the present invention is to be limited only by the following claims.

What is claimed is:

1. A chemical irritant dispensing apparatus comprising:

a) a frame having a handle with a cavity and a barrel with a bore, the barrel bore having a central axis defining a line of fire;

b) a chemical irritant fluid containing canister that occupies the cavity during use, the canister having an upper end portion with a valve and a trigger receptive recess;

c) a trigger that pivots upon the frame, the trigger being movably attached to the frame between "firing" and "non-firing" positions. wherein the trigger engages the canister and opens the valve to dispense the contents of the canister when the trigger is moved to the "firing" position; and d) wherein the canister and trigger are configured so that removal of the canister from the cavity is prevented by the trigger.

2. The chemical irritant dispensing apparatus of claim 1 further comprising a safety that prevents any substantial movement of the canister relative to the frame.

3. The chemical irritant dispensing apparatus of claim 1 wherein the fluid containing canister moves between dispensing and non-dispensing positions; wherein the canister moves toward the top of the frame when moving from a non-dispensing to a dispensing position.

4. The chemical irritant dispensing apparatus of claim 1 wherein the central longitudinal axis of the barrel and the central longitudinal axis of the canister form an angle of between about 50 and 140 degrees.

5. The chemical irritant dispensing apparatus of claim 1 wherein the barrel has a bore that includes a larger diameter section and a smaller diameter section.

6. The chemical irritant dispensing apparatus of claim 1 wherein the barrel has a smaller diameter section and a larger diameter section and further comprising a transverse dispensing channel that forms an angle of between 50 and 140 degrees with the central longitudinal axis of the barrel.

7. The chemical irritant dispensing apparatus of claim 1 further comprising a foam sleeve disposed within the barrel bore.

8. The chemical irritant dispensing apparatus of claim 1 wherein the frame is of a plastic material.

9. The chemical irritant dispensing apparatus of claim 1 wherein the frame is of a one-piece injection molded plastic material.

10. The chemical irritant dispensing apparatus of claim 1 wherein the trigger only rotates away from the barrel and toward the handle during use.

11. The chemical irritant dispensing apparatus of claim 1 further comprising means for preventing inadvertent movement of the canister relative to the frame, said means comprising a safety that is manually operable between safety and firing positions.

12. A chemical irritant dispensing apparatus comprising:

a) a frame having a handle with a cavity and a barrel, the barrel defining a line of fire;

b) a fluid containing canister that occupies the cavity during use, the canister being movable between dispensing and non-dispensing positions, wherein the canister moves upwardly toward the barrel when moving from a non-dispensing to a dispensing position;

c) a trigger that pivots upon the frame at the recess, the trigger being movably attached to the frame between "firing" and "non-firing" positions, wherein the trigger engages the canister and opens the valve to dispense the contents of the canister when the trigger is moved to the "firing" position; and d) wherein the canister and trigger are configured so that removal of the canister from the cavity is prevented by the trigger.

13. The chemical irritant dispensing apparatus of claim 12 further comprising a safety that prevents any substantial movement of canister relative to the frame.

14. The chemical irritant dispensing apparatus of claim 12 further comprising a return spring for urging the fluid containing canister to move to the non-dispensing position.

15. The chemical irritant dispensing apparatus of claim 12 wherein the central longitudinal axis of the barrel and the central longitudinal axis of the canister form an obtuse angle.

16. The chemical irritant dispensing apparatus of claim 12 wherein the barrel has a bore and further comprising a cylindrically shaped foam member disposed within the bore, the foam member having a central open ended bore through which chemical irritant is dispensed during use when the apparatus is fired.

17. The chemical irritant dispensing apparatus of claim 12 wherein the barrel has a bore that includes a larger diameter section and a smaller diameter section.

18. The chemical irritant dispensing apparatus of claim 12 wherein the frame is of a plastic material.

19. The chemical irritant dispensing apparatus of claim 12 wherein the frame is of a one piece injection molded plastic material.

20. The chemical irritant dispensing apparatus of claim 12 wherein the trigger only rotates away from the barrel and toward the handle during use.

21. The chemical irritant dispensing apparatus of claim 1 further comprising means for preventing inadvertent movement of the canister relative to the frame, said means comprising a safety that is manually operable between safety and firing positions.

22. A chemical irritant dispensing apparatus comprising:

a) a frame having a handle with a cavity and a barrel, the barrel defining a line of fire;

b) a fluid containing canister that occupies the cavity during use, the canister being movable between dispensing and non-dispensing positions, wherein the canister moves upwardly toward the barrel when moving from a non-dispensing to a dispensing position;

c) a trigger that pivots upon a frame, the trigger including a central pivot, a downwardly extending trigger member providing a gripping surface, a forwardly extending trigger rebound stop, and a rearwardly extending portion that engages and moves with the canister, wherein the trigger pivots to move the canister to the dispensing position and open the valve to dispense the contents of the canister when depressed by the user, the trigger rebound stop extending to the frame to prevent removal of the canister; and d) wherein the canister and trigger are configured so that removal of the canister from the cavity is prevented by the trigger.

* * * * *